US009254903B2

(12) United States Patent
Vallings et al.

(10) Patent No.: US 9,254,903 B2
(45) Date of Patent: Feb. 9, 2016

(54) GUIDE FOR A SAIL SLEEVE, SAIL COLLAPSING ARRANGEMENT AND METHODS THEREFOR

(71) Applicant: Alexander William Vallings, Lyn Maree Holland, Russell Thomas Davis acting together in trust for The Holland Vallings Family Trust, Auckland (NZ)

(72) Inventors: Alexander William Vallings, Auckland (NZ); Fraser Caldwell Brown, Cowes (GB)

(73) Assignee: Holland Vallings Family Trust, Auckland (NZ)

( * ) Notice: Subject to any disclaimer, the term of this patent is extended or adjusted under 35 U.S.C. 154(b) by 0 days.

(21) Appl. No.: 14/272,283

(22) Filed: May 7, 2014

(65) Prior Publication Data

US 2014/0238288 A1 Aug. 28, 2014

Related U.S. Application Data

(63) Continuation of application No. 13/201,441, filed as application No. PCT/IB2010/050641 on Feb. 12, 2010, now abandoned.

(30) Foreign Application Priority Data

Feb. 13, 2009 (NZ) ..... 574918

(51) Int. Cl.
*B63H 9/10* (2006.01)

(52) U.S. Cl.
CPC ..... *B63H 9/1092* (2013.01); *B63H 9/10* (2013.01); *B63H 9/1021* (2013.01)

(58) Field of Classification Search
CPC ..... B63H 9/00; B63H 9/06; B63H 9/10; B63H 9/0642; B63H 9/1092; B63H 9/1071
USPC ..... 114/102.1, 102.27, 104, 105
See application file for complete search history.

(56) References Cited

U.S. PATENT DOCUMENTS

| | | | |
|---|---|---|---|
| RE29,279 | E | 6/1977 | Fretwell, Jr. |
| 4,102,289 | A | 7/1978 | Ebbeson |
| 4,262,617 | A | 4/1981 | Svensson |
| 4,474,127 | A | 10/1984 | Stevenson, IV |
| 5,333,569 | A | 8/1994 | Henderson |

FOREIGN PATENT DOCUMENTS

| | | |
|---|---|---|
| WO | WO 95/23732 | 9/1995 |

OTHER PUBLICATIONS

International Search Report dated May 6, 2010 for corresponding PCT Application PCT/IB2010/050641.

*Primary Examiner* — Lars A Olson
(74) *Attorney, Agent, or Firm* — Laurence C. Bonar; Palmer IP

(57) ABSTRACT

The present invention provides for an inflatable sail guide arrangement for use in a sail collapsing arrangement. The sail collapsing arrangement is used for collapsing (also called "dousing" or "snuffing") a sail such as a spinnaker. The sail guide arrangement can be deflated for convenient storage and handling.

21 Claims, 13 Drawing Sheets

GUIDE FOR A SAIL SLEEVE, SAIL COLLAPSING ARRANGEMENT AND METHODS THEREFOR

CROSS-REFERENCE TO RELATED APPLICATIONS

This application claims priority to U.S. patent application Ser. No. 13/201,441, filed Oct. 26, 2011 which is the U.S. National Phase of PCT/IB2010/050641 filed Feb. 12, 2010 and claims priority to New Zealand Provisional Patent Application No. 574918 filed Feb. 13, 2009, which is hereby incorporated herein by reference in its entirety.

TECHNICAL FIELD

The present invention relates to a guide for a sail sleeve, for use in collapsing, dousing or snuffing a sail of a sailing boat to facilitate convenient storage of the sail. More particularly but not exclusively it relates to a guide for allowing a user to pull a sail sleeve over a sail, to facilitate handling of the sail during the dousing and lowering of the sail.

BACKGROUND OF THE INVENTION

Sail sleeves are well known for use in sailing, and in particular for use with spinnaker sails on sailboats around the world. Prior art sleeves are generally in the form of a fabric sleeve and a guide arrangement that is connected to up-haul and down-haul lines. Their primary function is to be pulled over a spinnaker sail from the top down, thereby to "douse" the sail (i.e. cause collapsing of the sail, making it lose its wind). Such sail sleeves may be typically used in conjunction with a prior art rigid guide which is pulled over the sail. The prior art rigid guide assists in forcing the side edges of the sail to collapse towards each other, and prevents abrasion on the sail sleeve itself. The combination of the guide and sail sleeve are generally known as a sail "douser" or "snuffer".

Snuffers or dousers are typically used on larger sized sailing vessels—from about 40 feet long. They facilitate the de-rigging of in particular spinnaker sails, and may be particularly useful where a large surface area of the sail may make manual handling of the sail difficult, or for short-handed sailing.

Currently the guides for dousers are typically moulded of light material such as Kevlar or carbon fibre composites, or glass fibres.

WIPO Publication Number WO 95/23732 discloses a snuffer including a sail sleeve and a ring shaped guide having flare shaped edges folded up about 180 degrees to help prevent damage to the sail. However, this invention may be dangerous to the vessel and boat crew during use.

U.S. patent publication Number U.S. Pat. No. 4,262,617 discloses a sail douser including a resilient helical formation which tightens around the sail and douses it when an associated douser guide ring is pulled down over the sail. This guide ring may not facilitate the storage of the douser and sail together below deck, and the ring may still be damaging to rigging and dangerous to deck hands while being rigged.

Reissued U.S. patent publication number RE29,279 discloses a device for launching and dousing light sails such as spinnakers. This invention uses a series of parallel snuffer guides connected by lines, instead of a sail sleeve. However, this design may be dangerous and potentially damaging to the rigging or the vessel, since a series of rigid guides could be swinging about above deck. These series of rings also may need to be removed from the spinnaker before storage of the sail.

In this specification, where reference has been made to external sources of information, including patent specifications and other documents, this is generally for the purpose of providing a context for discussing the features of the present invention. Unless stated otherwise, reference to such sources of information is not to be construed, in any jurisdiction, as an admission that such sources of information are prior art or form part of the common general knowledge in the art.

SUMMARY OF THE INVENTION

In a first aspect the present invention broadly consists in a guide arrangement suitable for use in a sail collapsing arrangement, said guide arrangement comprising a resilient inflatable bladder configured and dimensioned to receive a sail at least partially through it, thereby causing the collapse of said sail.

Preferably, the resilient inflatable bladder comprises an inflatable body member at least partially defining an aperture;

wherein the aperture is configured and dimensioned for operationally crimping a sail through it, to thereby cause collapse of said sail; and wherein said resilient inflatable bladder is protected against abrasion by said sail by a flexible abrasion resistant lining formation disposed at least partly around the inside of the aperture.

Preferably, the abrasion resistant lining formation also protects the inflatable bladder from heat and friction.

Preferably, the inflatable bladder is toroidally shaped.

Preferably, the inflatable bladder is ellipsoid shaped.

Preferably, the inflatable bladder is composed of resilient material.

Preferably, the inflatable bladder is composed of flexible material.

Preferably, the inflatable bladder is composed at least partially of one or more selected from rubber, rubberised material (such as Hypalon™ or Stronganⁿ™)

silicon;

plastic material;

polyurethane;

Polyvinyl Chloride (PVC);

or any other suitable material.

Preferably, the inflatable bladder is configured and adapted to be inflated and deflated by pressurised fluid.

Preferably, the inflatable bladder includes at least one inflation valve.

Preferably, the inflation valve is configured and adapted to allow both inflation and deflation of the inflatable bladder.

Preferably, the inflatable bladder includes a deflation valve.

Preferably, one or more selected from the inflation valve and/or the deflation valve are located on the inflatable bladder at a location for convenient access to one or more selected from the inflation valve and/or the deflation valve.

Preferably, the abrasion resistant lining formation is configured for lining at least an inner region of the inflatable bladder against abrasion.

Preferably, one or more selected from the inflatable bladder and the abrasion resistant lining is comprised of abrasion resistant material.

Preferably, the abrasion resistant material is one or more selected from

Ultra high molecular weight polyethylene (such as Cuben™ or Spectra™);

aramid synthetic fiber (including para- and meta- aramids such as Kevlar™, Twaron™ and Nomex™)
coated polyester fibers (such as Fiesta™)
or any other suitable material.

Preferably, the guide arrangement further comprises a lining sleeve onto which lining formations are incorporated.

Preferably, the lining sleeve is flexible.

Preferably, the lining sleeve is resilient.

Preferably, the resilient inflatable bladder is receivable into the lining sleeve.

Preferably, the abrasion resistant lining formation is integrally formed with the lining sleeve.

Alternately, the lining sleeve is made of flexible abrasion resistant material.

Alternately, the abrasion resistant lining formation is secured to the lining sleeve.

Preferably, the lining sleeve comprises access apertures for allowing convenient access to the inflation valve and/or the deflation valve.

Preferably, the, the access apertures include closure formations.

Preferably, the closure formations comprise a zip closure.

Preferably the guide arrangement includes at least one securing formation configured and dimensioned to be securable to at least one or more selected from
an up-haul line; and
a down-haul line.

Preferably, the guide arrangement comprises a plurality of securing formations.

Preferably, the securing formations are secured to the inflatable bladder.

Alternately, the securing formations are secured to the lining sleeve.

Preferably, the guide arrangement includes sleeve securing formations adapted and configured for being secured to a sail sleeve.

Preferably, the sleeve securing formations extend from the lining sleeve.

Preferably, the sleeve securing formations are one or more selected from
zip formations;
hook formations;
eyelet formations; and
loop formations.

Preferably, the inflatable bladder includes a release valve.

Preferably, the release valve is configured to release the pressure of the pressurised fluid inside the inflatable bladder at a predetermined pressure level.

Preferably, the predetermined pressure level is at a pressure that the inflatable bladder is safely rated at.

Preferably, the release valve's predetermined pressure level is adjustable.

Preferably, the pressurised fluid is supplied from one or more selected from a high pressure reservoir and a pump.

Preferably, the pressurised fluid is one or more selected from a gas and a liquid.

Preferably, the pressurised fluid is a fluid which has a relatively low thermal expansion gradient.

Preferably, the pressurised fluid is one or more of a gas selected from air,
nitrogen,
helium, or
a noble gas.

Alternatively, the pressurised fluid is pressurised water.

In another aspect the present invention broadly consists in a guide arrangement suitable for use in a sail collapsing arrangement, said guide arrangement comprising
a resilient inflatable bladder comprising an inflatable body member at least partially defining an aperture; and
at least one securing formation configured and dimensioned to be securable to at least one selected from
an up-haul line; and
a down-haul line;
wherein the inflatable body member is configured and dimensioned for operationally crimping a sail through the aperture, to thereby cause the collapse of said sail;

Preferably, the guide arrangement further comprises a plurality of securing formations.

Preferably, the resilient inflatable bladder is protected against abrasion by said sail by a flexible abrasion resistant lining formation disposed at least partly around the inside of the aperture.

Preferably, the guide arrangement further comprises a lining sleeve onto which lining formations are incorporated.

Preferably, the securing formations are secured to the inflatable bladder.

Alternately, the securing formations are secured to the lining sleeve.

Preferably, the guide arrangement includes sleeve securing formations adapted and configured for being secured to a sail sleeve.

Preferably, the sleeve securing formations extend from the lining sleeve.

Preferably, the sleeve securing formations extend from the inflatable bladder sleeve.

Preferably, the sleeve securing formations are one or more selected from
zip formations;
hook formations;
eyelet formations; and
loop formations.

In another aspect the present invention broadly consists in a lining sleeve suitable for use in a sail collapsing arrangement for collapsing a sail, wherein said lining sleeve
is adapted and configured to receive at least part of an inflatable bladder that at least partly defines an aperture, and
wherein said lining sleeve includes at least one flexible abrasion resistant lining formation disposed at least partly around the inside of the aperture of the inflatable bladder, for protecting said inflatable bladder against abrasion by a sail during collapsing of said sail.

Preferably, the lining sleeve is flexible.

Preferably, the lining sleeve is resilient.

Preferably, the abrasion resistant lining formation is integrally formed with the lining sleeve.

Alternately, the lining sleeve is made of flexible abrasion resistant material.

Alternately, the abrasion resistant lining formation is secured to the lining sleeve.

Preferably, the lining sleeve comprises access apertures for allowing convenient access to the inflatable bladder.

Preferably, the access apertures include closure formations.

Preferably, the closure formations comprise a zip closure.

Preferably the lining sleeve includes at least one securing formation configured and dimensioned to be securable to at least one or more selected from
an up-haul line; and
a down-haul line.

Preferably, the lining sleeve comprises a plurality of securing formations.

Preferably, the lining sleeve includes sleeve securing formations adapted and configured for being secured to a sail sleeve.

Preferably, the sleeve securing formations are one or more selected from zip formations;

hook formations;

eyelet formations; and loop formations.

In another aspect the present invention may be said to broadly consist in a sail collapsing arrangement comprising a guide arrangement as described above; and a sail sleeve securable to the guide arrangement.

Preferably, the sail collapsing arrangement further comprises at least one line securing formation for securing the sail collapsing arrangement to a line.

Preferably, the sail collapsing arrangement further comprises a plurality of line securing formations for securing the sail collapsing arrangement to a plurality of lines.

Preferably, the sail collapsing arrangement further comprises at least one line securable to the guide arrangement.

Preferably, the sail collapsing arrangement further comprises at least one up-haul line and at least one down-haul line securable to the guide arrangement.

Preferably, the up-haul line and the down-haul line are a single endless line extending from one side of the guide arrangement to the other side of the guide arrangement via at least one pulley.

Preferably, the sail collapsing arrangement includes at least one pulley securing formation for securing a pulley to the sail sleeve at or towards the top end of the sail sleeve.

Preferably, the sail collapsing arrangement includes at least one pulley securable or secured to the sail sleeve at or towards the top end of the sail sleeve.

Preferably, the endless line extends from the guide arrangement at one end, through the pulley and back to the guide arrangement.

Preferably, the up-haul and /or down-haul line are received into a line passage.

Preferably, the line passage extends at least partially down the length of the sail sleeve.

Preferably, the sail sleeve is configured and dimensioned to receive a substantial portion of the length of a sail to be stored within the sleeve.

Preferably, the sail sleeve has a top end and a lower end.

Preferably, the sail sleeve is removably securable to the guide arrangement.

Preferably, the sail sleeve is removably securable to the guide arrangement at its lower end.

Alternately, the sail sleeve is permanently securable to the guide arrangement.

Preferably, the sail sleeve is securable to the guide arrangement by a sleeve securing formation.

Preferably, the sleeve securing formation is one or more selected from zip formations;

hook formations;

eyelet formations; and loop formations.

Preferably, the sail collapsing arrangement includes a sail connecting arrangement for connecting a sail to the sail sleeve towards its top end.

Preferably, the sail connecting arrangement includes a swivel device to allow the sail to swivel relative to the sail sleeve.

Preferably, the sail connecting arrangement includes a strop formation for connecting the swivel device towards the top end of the sail sleeve.

Preferably, the sail sleeve has a rigging formation for coupling the sail sleeve to a mast.

Preferably, the rigging formation is an eyelet. In another aspect the present invention may be said to broadly consist in a sailing boat including a guide arrangement as described above.

In another aspect the present invention may be said to broadly consist in a sail collapsing arrangement including a guide arrangement as described above.

In another aspect the present invention may be said to broadly consist in a method of rigging a sail comprising the steps, not necessarily being in chronological order, of providing a sail collapsing arrangement as described within which a sail to be rigged is at least partially received into the sail sleeve;

inflating the inflatable bladder;

coupling the guide arrangement to an up-haul line;

coupling the sail towards the top of a sailing boat's mast.

Preferably, the, method includes the step of pulling on the up-haul line to unsheathe the sail from the sail sleeve.

Preferably, the method includes the step of coupling the guide arrangement to a down-haul line before pulling on the up-haul line.

Preferably, the method includes the step of coupling the sail to its control lines.

In another aspect the present invention may be said to broadly consist in a method of de-rigging a sail having been rigged as described above, said method comprising the steps, not necessarily being in chronological order, of pulling on a down haul line to pull the guide arrangement over the sail, thereby crimping it and causing it to collapse;

decoupling the sail from a sailing boat's mast;

decoupling the sail from its control lines;

decoupling the guide arrangement from an up-haul line;

decoupling the guide arrangement from a down-haul line;

deflating the inflatable bladder.

In another aspect the present invention may be said to broadly consist in a method of storage of a sail at least partially received into a sail collapsing arrangement as described, said method comprising the steps of deflating the inflatable bladder of the sail collapsing arrangement;

inserting the sail and sail collapsing arrangement through a forward hatch of a sailing boat.

For the purposes of this specification, the term "plastic" shall be construed to mean a general term for a wide range of synthetic or semisynthetic polymerization products, and generally consisting of a hydrocarbon-based polymer.

For the purposes of this specification, the term "sailing boat" shall be construed to mean a general term for a any boat or vessel having including a sail, kite or surface which harnesses wind energy to at least partially assist in driving the vessel.

For the purposes of this specification, the term "crimp" shall be construed to mean the collapsing, folding, pinching crushing or drawing together of material such as that in a sail, and the terms "crimping" or "crimped" are to be construed accordingly.

For the purposes of construing this specification and claims, when a method is described including a plurality of steps, those steps are not necessarily intended to be carried out in the chronological order that they are shown in, unless logic dictates that the need to be.

Other aspects of the invention may become apparent from the following description which is given by way of example only and with reference to the accompanying drawings.

As used herein the term "and/or" means "and" or "or", or both.

As used herein "(s)" following a noun means the plural and/or singular forms of the noun.

The term "comprising" or "including" as used in this specification means "consisting at least in part of". When interpreting statements in this specification which include that term, the features, prefaced by that term in each statement, all need to be present but other features can also be present. Related terms such as "comprise" and "comprised" and "include" and "included" are to be interpreted in the same manner.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

The invention will now be described by way of example only and with reference to the drawings in which.

DETAILED DESCRIPTION OF THE PREFERRED EMBODIMENT(S)

With reference to the above drawings, in which similar features are generally indicated by similar numerals, a sail collapsing arrangement according to a first aspect of the invention is generally indicated by the numeral 100, and a guide arrangement suitable for use in a sail collapsing arrangement is generally indicated by the numeral 200.

Figure 1:
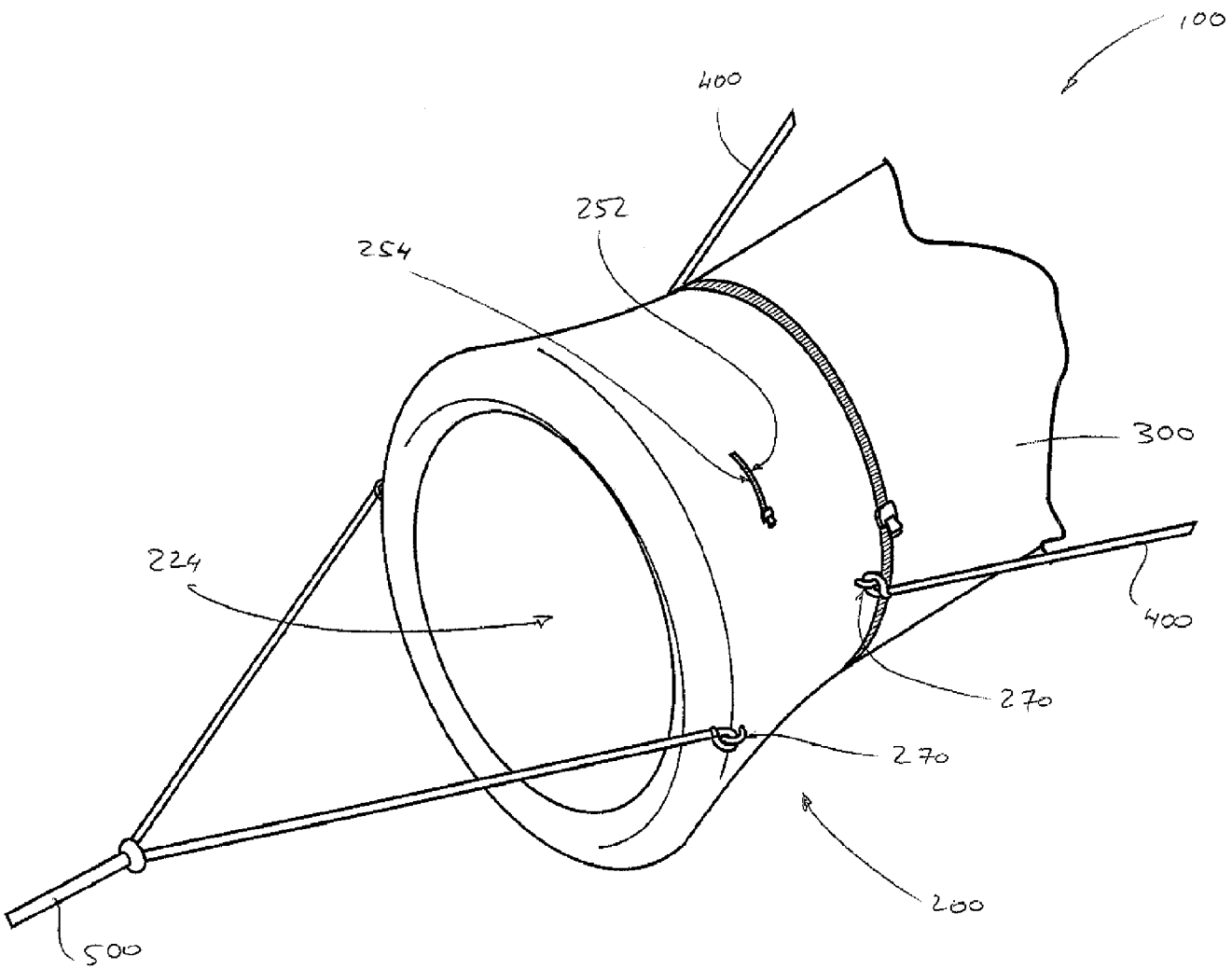
FIG. 1: shows a cutaway perspective view of a sail collapsing arrangement.
Figure 2:
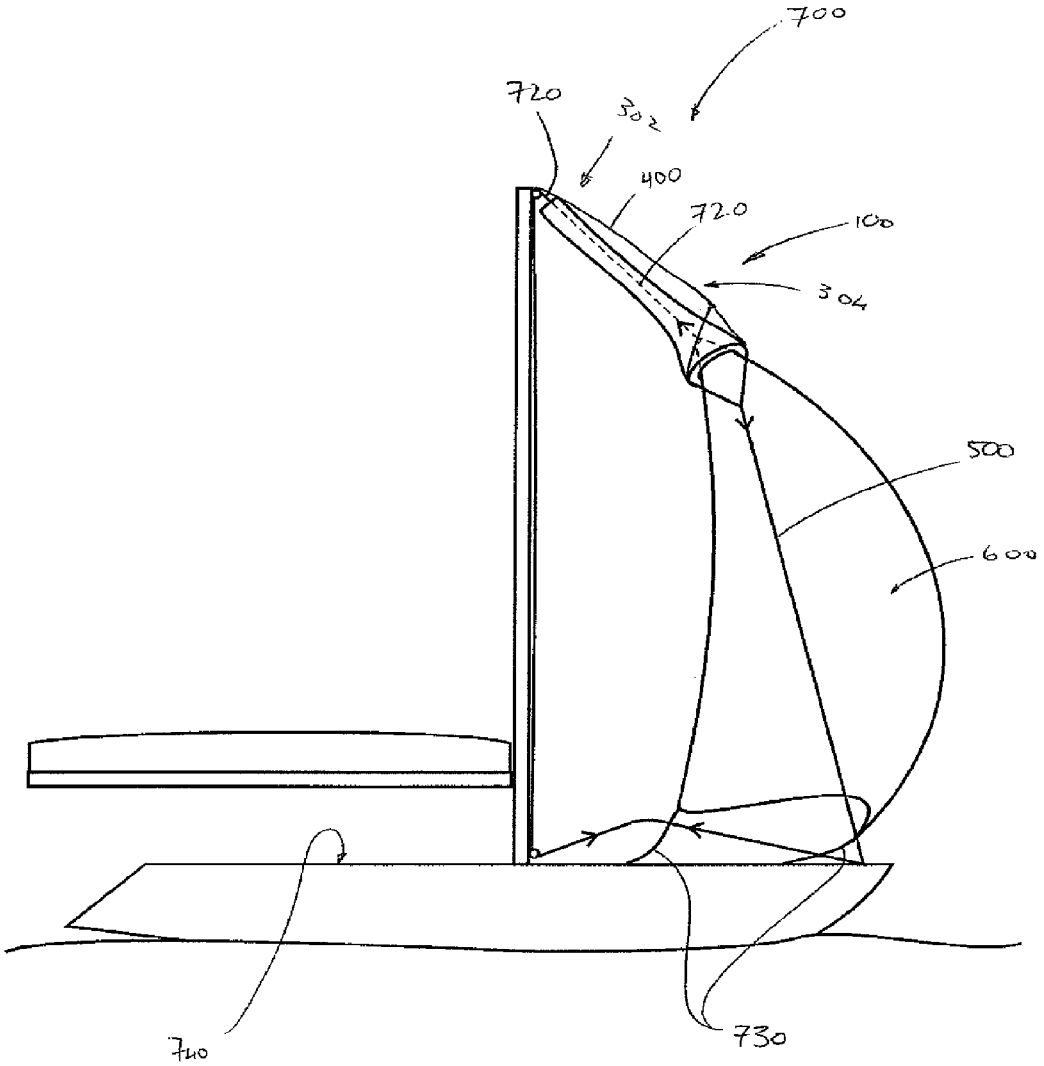
FIG. 2 shows a schematic view of a sailing boat with a sail collapsing arrangement rigged.

In one embodiment now described, and as shown in FIGS. 1 and 2, a sail collapsing arrangement 100 is provided. The sail collapsing arrangement 100 comprises a guide arrangement 200, and a sail sleeve 300. The sail sleeve has a top end 302 and a lower end 304, and is securable to the guide arrangement 200 by sleeve securing formations 280 at its lower end 304.

In a preferred embodiment, the sleeve securing formations 280 allow the sail sleeve 300 to be removably securable to the guide arrangement 200. It is envisaged that the sleeve securing formations 280 will preferably comprise a zip formation (as shown in the figures), but could also be any one or more of hook formations; eyelet formations; and loop formations, or any other suitable configuration.

Alternately, in another embodiment not shown, it is envisaged that the sail sleeve 300 can be permanently secured to the guide arrangement 200 by stitching, bonding, or the like.

The sail sleeve 300 is typically configured and dimensioned to receive a substantial portion of the length of a sail 600 within the sail sleeve 300. It is envisaged that said sail 600 will be stored as received into the sail sleeve 300 (at least during sailing of the sailing boat 700).

Figure 13:
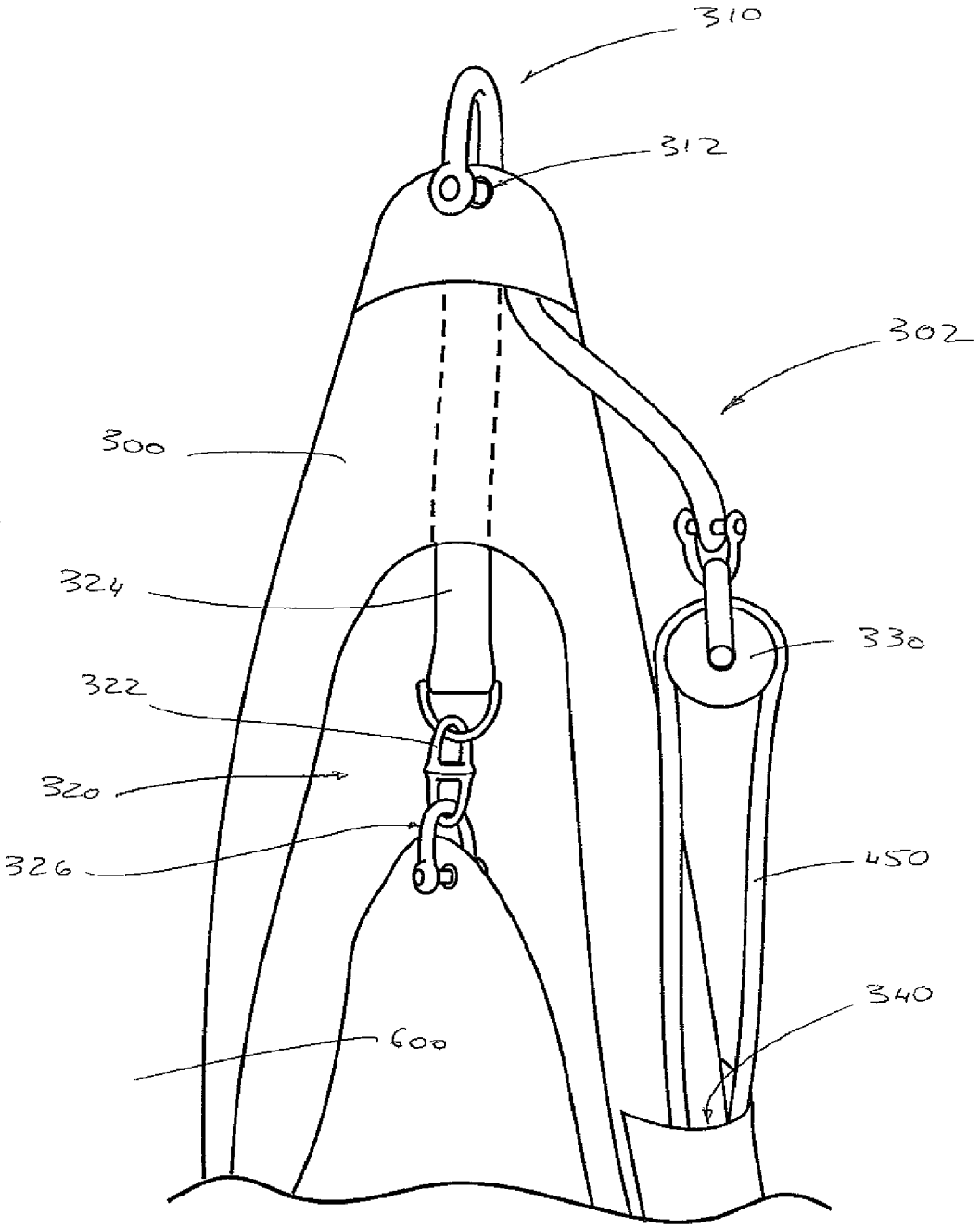
FIG. 13: shows a cutaway side view of the top end of a sail sleeve of a sail collapsing arrangement.

As shown in FIG. 13, the sail sleeve includes a sail connecting arrangement 320 in the form of a strop formation 324, swivel device 322 and D-shackle 326 for connecting a sail 600 to the sail sleeve 300 towards its top end 302. The swivel device 322 is attached to the sail by the D-shackle 326 and allows the sail 600 to swivel relative to the sail sleeve 300. In a preferred embodiment, the strop formation 324 is directly sewn onto or secured to the sail sleeve 300, but in an alternative embodiment (not shown) it could also be secured to the sail sleeve 300 by a shackle (not shown).

The sail sleeve 300 also includes a rigging formation 310 in the form of an eyelet 312 for coupling the sail sleeve 300 to a sailboat's mast via rigging line 720 (such as a halyard). In one embodiment shown in FIGS. 3-6, the guide arrangement 200 comprises a resilient inflatable bladder 220, a lining sleeve 250, securing formations 270 and an abrasion resistant lining formation 260.

The inflatable bladder 220 is preferably composed of a resilient material such as rubber, rubberised material, silicon; plastic; polyurethane; PVC; or any other suitable material. The inflatable bladder 220 is configured and dimensioned in the shape of an ellipsoid toroid, including an inflatable body member 222 defining an aperture 224 suitable for receiving a suitably dimensioned sail 600 (such as a spinnaker) through it's centre aperture to crimp the sail 600, thereby causing its collapse.

In alternative embodiments, it is envisaged that alternately shaped inflatable bladders 220 may be used.

In use, it is envisaged that the sail collapsing arrangement will be stored with the sail 600 received within the sail sleeve 300. In order to rig the sail 600, one end of the sail 600 and sail collapsing arrangement 100 will be attached to a rigging line 720 such as a halyard on the sailing boat 700 for pulling the opposed end of the sail sleeve 300 from the guide arrangement 200 to the top of the sailing boat's mast 710. It is envisaged that the sail 600 will also be attached directly or indirectly to this rigging line 720, thereby rigging the sail 600.

Once the sail 600 and sail collapsing arrangement 100 has been pulled to the top of the mast 710, it is secured in this position. At this stage, or even before rigging the sail 600 and sail collapsing arrangement 100 to the mast, the up-haul line and down haul lines are then attached to the sail collapsing arrangement 100, and coupling sail control lines 730 for controlling the sail 600 at or towards the deck of the sailing boat 700.

In order to set the newly rigged sail 600, the up haul line is then pulled upwards, to unsheathe the sail 600. As the sail 600 is exposed to the wind, it typically sets and is then controllable by the sail control lines 730 according to known sailing practice. Typically, as the sail 600 starts setting as it is unsheathed, the setting sail 600 tends to push the guide arrangement 200 upwardly, so that the up-haul line may not even need to be pulled on, and in fact the down haul line may need to be held to slow the rate of ascent of the guide arrangement 200 up the sail 600 as it nears the top of the sail 600 to prevent damage to the mast 710 or other rigging (not shown).

By controlling the speed with which the sail 600 is collapsed or unsheathed, the setting and collapsing of the sail can be controlled in an orderly fashion.

The lighter the guide arrangement 200 is, the quicker the guide arrangement 200 can be expected to ascend the sail 600. Having a lighter guide arrangement 200 will provide an advantage during racing conditions, since a lighter guide arrangement means that the full sail 600 can be set more quickly.

In use, to take a sail 600 down the inflatable bladder 220 is pulled downwardly over the sail 600. The sail will typically not be set with its control lines 730 still secured, but will still be billowing with wind, and be at least partially still filled with wind. As the inflatable bladder 220 moves along the length of the sail 600, the opposed side edges of the sail 600 will be constricted towards each other, thereby causing the sail 600 to collapse and lose its wind, making the sail easier to handle by crew (not shown).

In a preferred embodiment, the inflatable bladder 220 further includes an inflation/deflation valve 230 configured and adapted for allowing inflation of the inflatable body member 222, by pressurised fluid (whether gas or liquid), by using a compressor, a pump, a pressurised reservoir, lung pressure or the like, and deflation of the inflatable body member 222 by release of a deflation mechanism (not shown) in the inflation/deflation valve 230.

Preferably, the inflation/deflation valve 230 are located towards the upper side of the inflatable body member 222 for convenient access when the guide arrangement 200 is lying on a deck of a sailing boat 700.

In an alternative embodiment (not shown), it is envisaged that a separate inflation valve and deflation valve can be provided.

In an even more preferred embodiment, the inflatable bladder 220 further includes a release valve 290. The release valve is configured to release the pressure of the fluid (whether gas or liquid) inside the inflatable bladder 220 at a predetermined pressure.

The predetermined pressure is envisaged to be at a pressure that the inflatable bladder 220 is safely rated at. In this way, the release valve 290 allows the inflatable bladder 220 to be filled up quickly from a high pressure reservoir or pump (not shown) while preventing rupture of the inflatable bladder 220 by the pressurised fluid within it. In a preferred embodiment, the release valve's 290 predetermined pressure level will be adjustable.

It is envisaged that the pressurised fluid used for filling the inflatable bladder 220 will typically be compressed air from a compressor or pressurised tank (not shown), however it is envisaged that in alternative embodiments, a pressurised gas, such as nitrogen or the like, may be used that has a relatively small thermal expansion gradient (i.e. tendency to expand or contract for given temperature variances). In this way, temperature changes will not affect the rigidity of the inflated inflatable bladder 220 as much.

It is further envisaged that where the inflatable bladder 220 is required to be very rigid, a liquid such as water or even salt water may be used to inflate the inflatable bladder 220.

In the embodiments shown in FIGS. 3-4 and 7-8, the guide arrangement includes a chafe cover or lining sleeve 250 which is a flexible resilient sleeve into which the inflatable bladder 220 is received, and takes on the shape of the inflatable bladder 220. In a preferred embodiment the inflatable bladder is received into the lining sleeve through a receiving aperture 256 which is closed by a receiving zip closure 258. However In these embodiments the lining sleeve 250 is also ellipsoidally toroidal in shape. The lining sleeve 250 includes access apertures 252 for allowing convenient access to the inflation/deflation valve 230 on the inflatable bladder 220. The access apertures 252 are lined by closure formations 254 (shown in the form of zip closures). It is envisaged that the closure formations 254 could also be hook and loop closure formations (such as Velcro™), hook and eye formations, or any other suitable closure formations 254.

Figure 3:
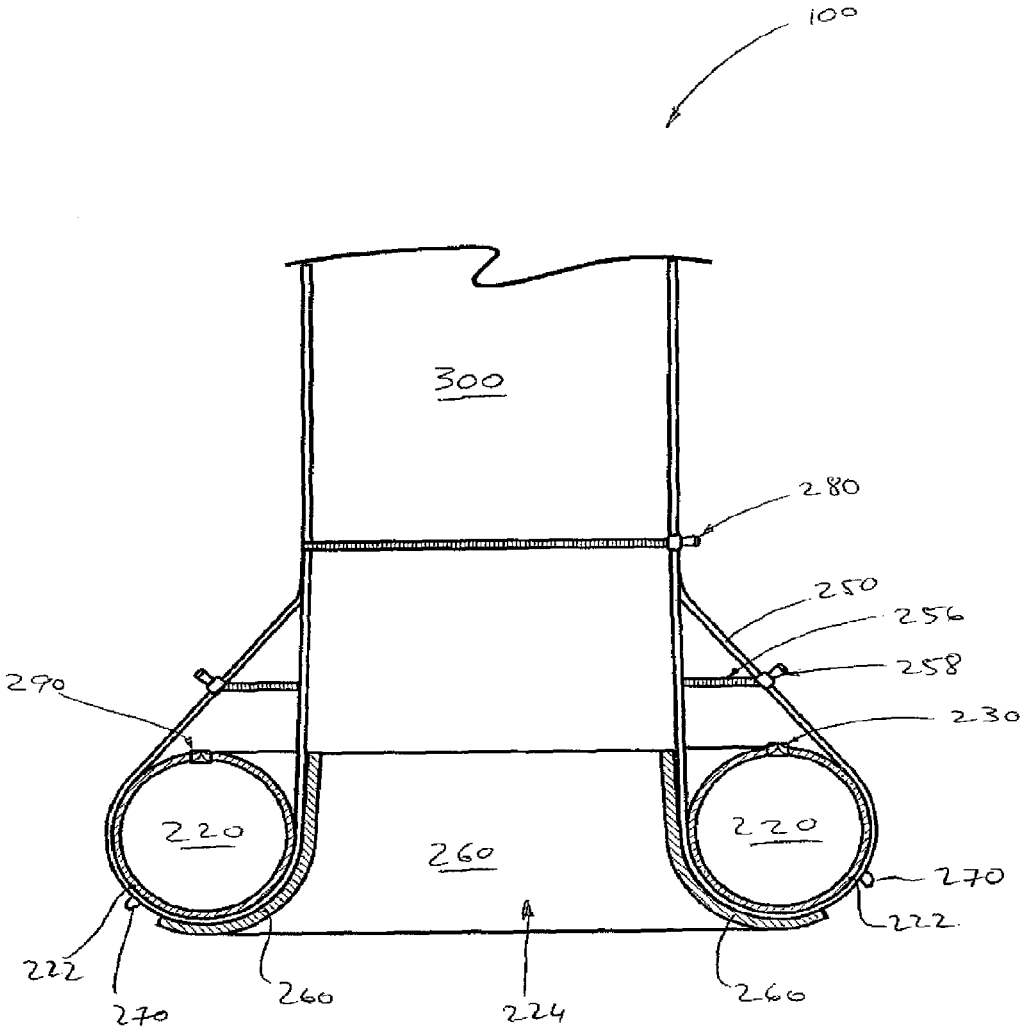
FIG. 3: shows a cutaway side view of a first embodiment of a sail collapsing arrangement.
Figure 4:
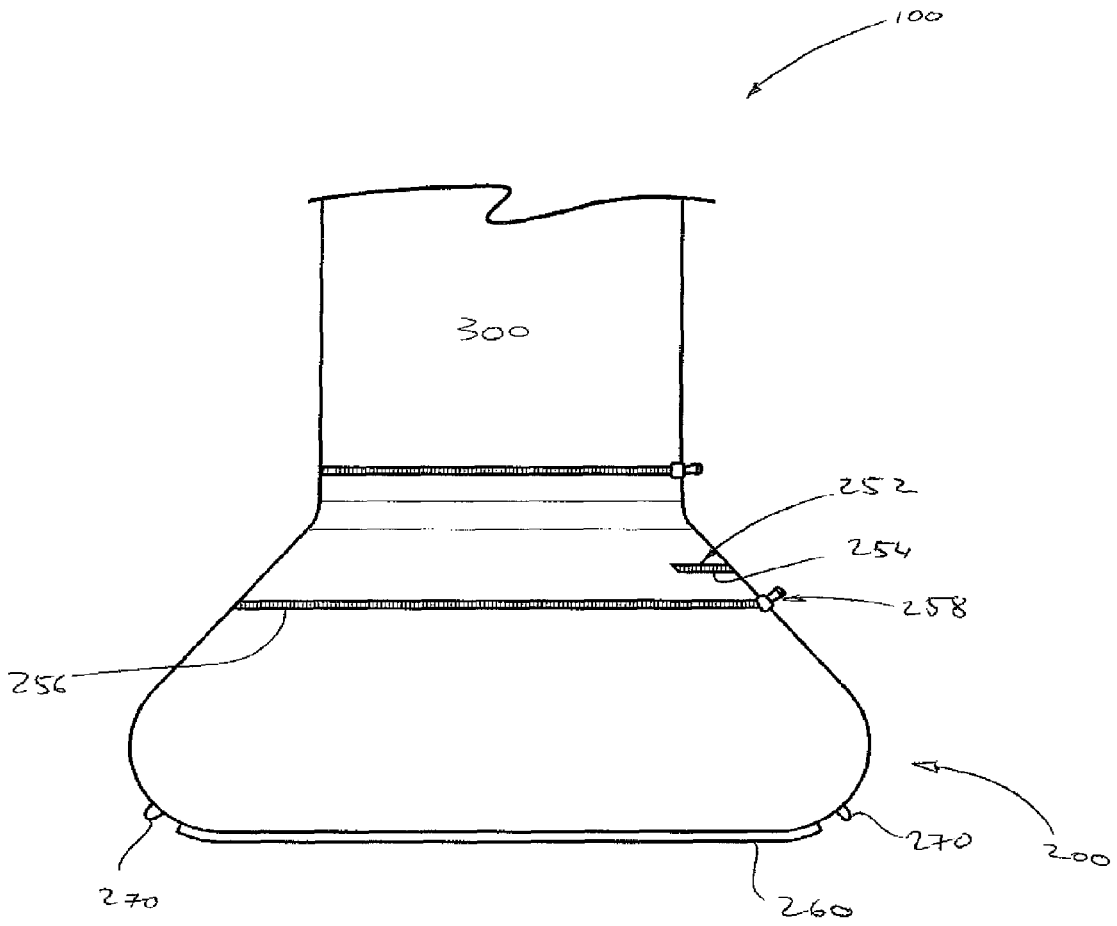
FIG. 4: shows a cutaway side view of the first embodiment of a sail collapsing arrangement of FIG. 3.

In the embodiment shown in FIGS. 3-4, the lining sleeve 250 also includes an abrasion resistant lining formation 260. The abrasion resistant lining formation 260 is composed of a flexible abrasion resistant material, such as Spectra™; Kevlar fibre; or the like.

The abrasion resistant lining formation 260 is for lining the lining sleeve 250 at least the inside of the aperture 224 in the inflatable body member 222 against abrasion by a sail 600 during collapsing or setting of the sail 600, but preferably extends around the outside of the inflatable bladder 220 to help prevent puncture of the inflatable bladder 220 by rigging or the like. In the embodiment shown in FIGS. 3-4, the lining formation 260 may be secured to the lining sleeve by adhesion, heat bonding, or a mechanical bond (not shown).

Figure 7:
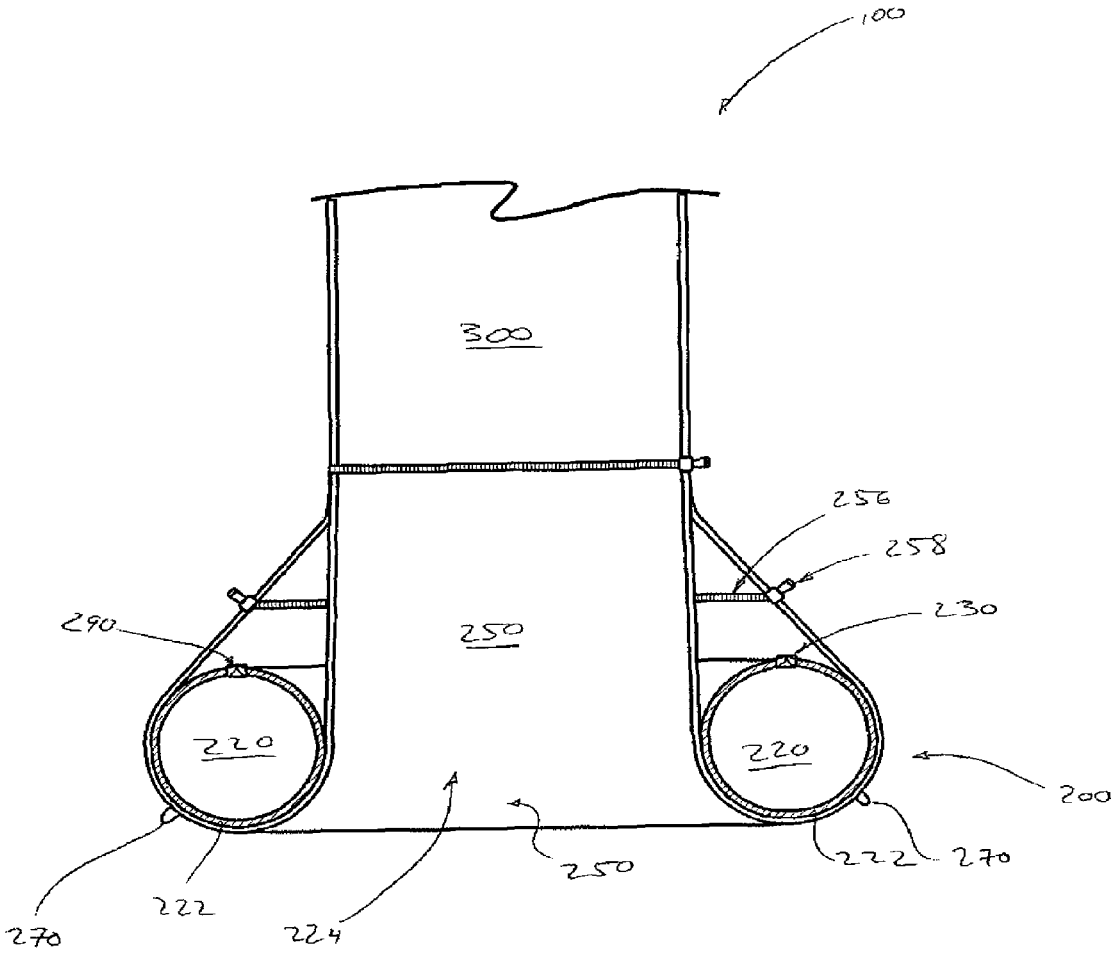
FIG. 7: shows a cutaway side view of a third embodiment of a sail collapsing arrangement.
Figure 8:
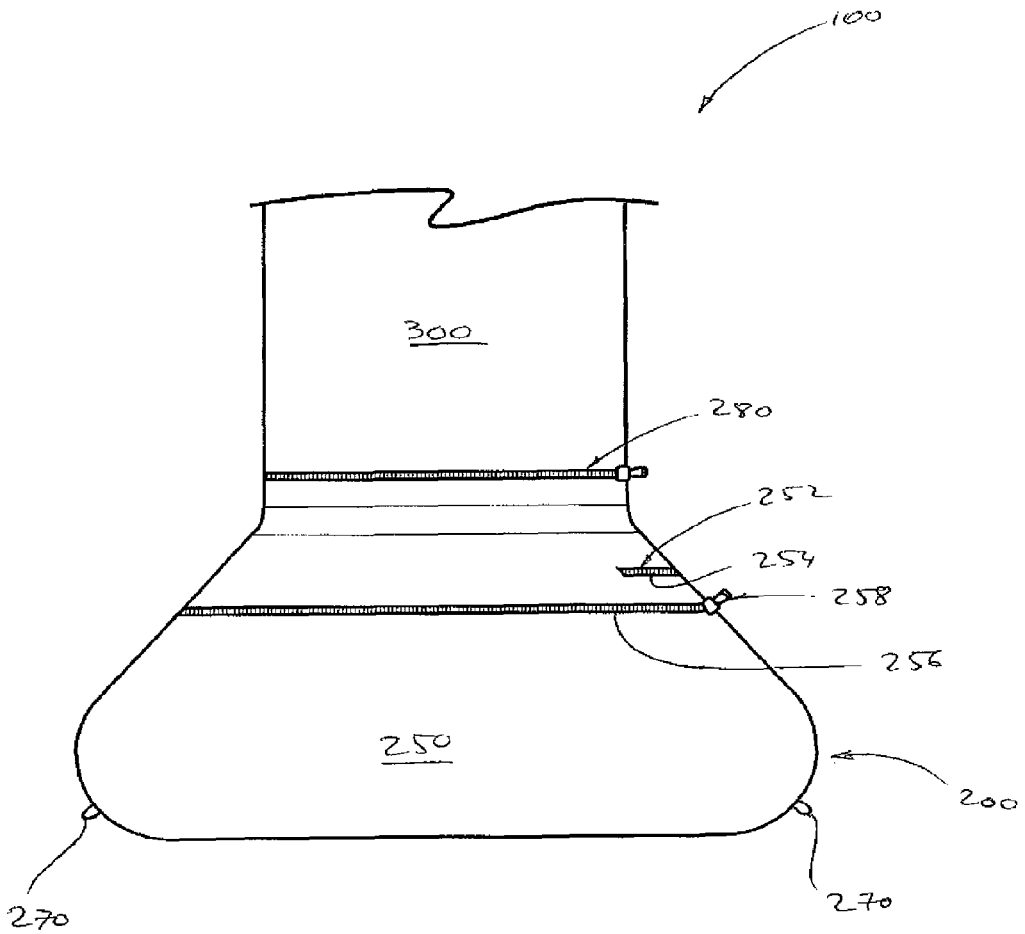
FIG. 8: shows a cutaway side view of the third embodiment of a sail collapsing arrangement of FIG. 7.

In another embodiment (as shown in FIGS. 7-8) the lining sleeve 250 may itself be composed of flexible abrasion resistant material as described for the lining formation 260, and in this way no further abrasion resistant lining formation 260 will be required to impart abrasion resistance to the lining sleeve 250. In such a case the abrasion resistant lining formations 260 may be said to be integrally formed with the lining sleeve 250.

In another embodiment as shown in FIGS. 5-6 and 9-10, no lining sleeve 250 is required at all. Instead, the lining sleeve 250 is integrally formed with the inflatable bladder 220. In such a case, the inflatable bladder 220 itself includes sleeve securing formations 280 for securing the inflatable bladder 220 to the sail sleeve 300, as well as securing formations 270 for securing the inflatable bladder 220 to an up-haul line 400 and down-haul line 500.

Figure 5:
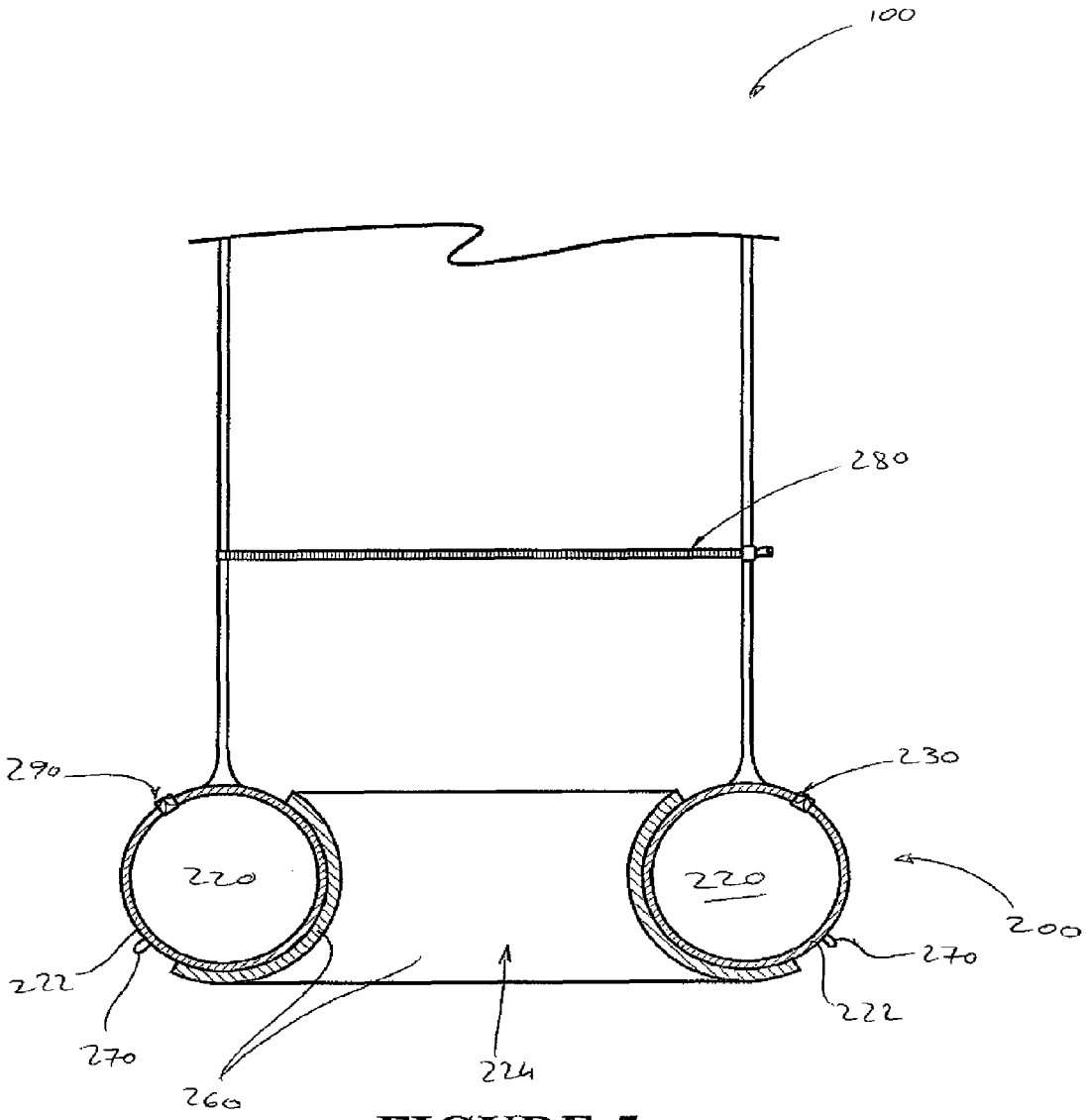
FIG. 5: shows a cutaway side view of a second embodiment of a sail collapsing arrangement.
Figure 6:
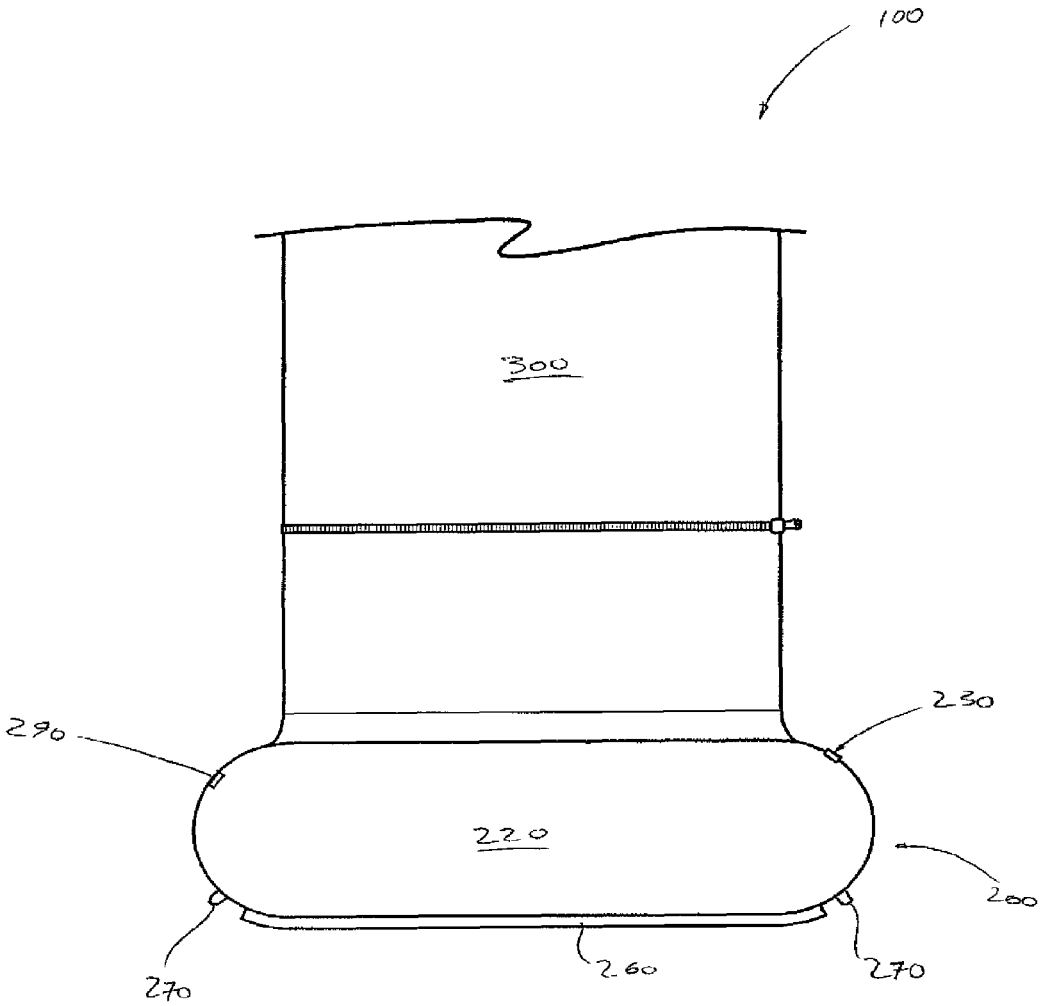
FIG. 6: shows a cutaway side view of the second embodiment of a sail collapsing arrangement of FIG. 5.
Figure 9:
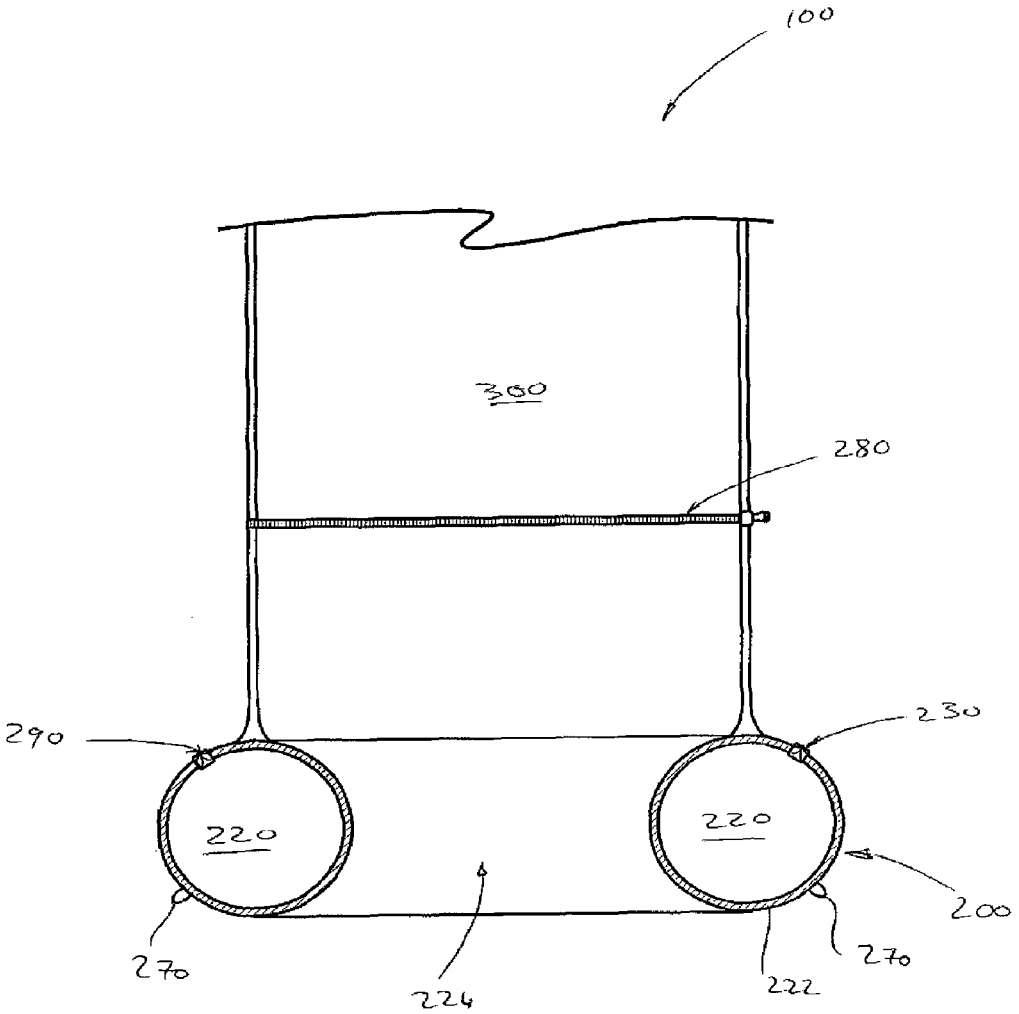
FIG. 9: shows a cutaway side view of a fourth embodiment of a sail collapsing arrangement.
Figure 10:
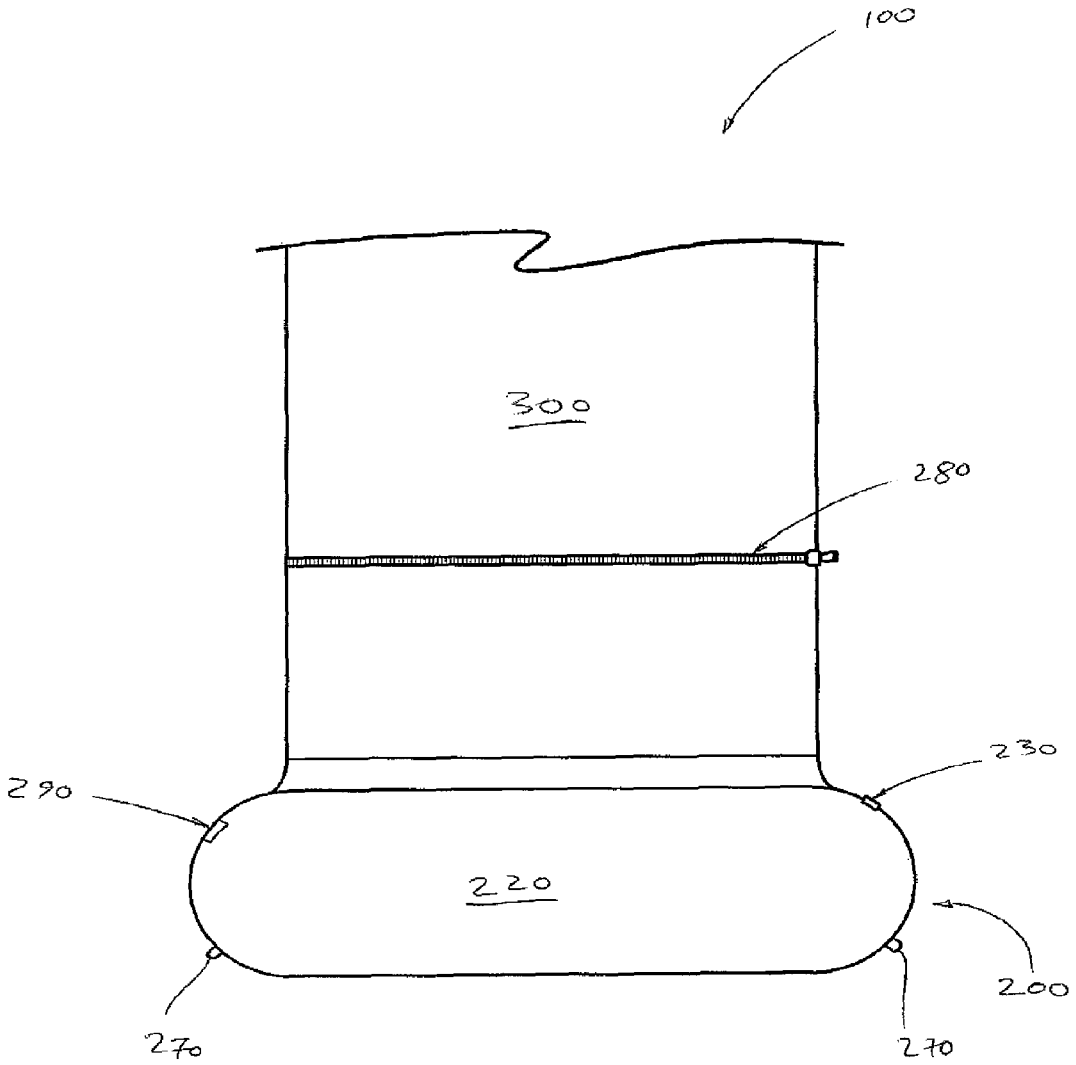
FIG. 10: shows a cutaway side view of the fourth embodiment of a sail collapsing arrangement of FIG. 9.

Further, in such an embodiment, the inflatable bladder 220 itself can include abrasion resistant lining formations 260 (as shown in FIG. 5-6) or could alternately be itself composed of an abrasion resistant material (as shown in FIGS. 9-10). It is envisaged that this may be accomplished by using a laminated material with one layer of resilient airtight material laminated to another layer of abrasion resistant material.

Alternately, a sheet of flexible abrasion resistant material fibres may be impregnated with resilient flexible airtight material such as PVC, plastic or silicon.

The guide arrangement further includes two pairs of securing formations 270 (shown in FIG. 1 as loop formations) that are configured and dimensioned to be securable to an up-haul line 400; and a down-haul line 500. It is envisaged that in another embodiment the up-haul line 400 and the down-haul line 500 may be secured to the same securing formations 270. In the embodiments shown in FIGS. 3-4 and 7-8, the securing formations 270 will be directly connected to the lining sleeve 250, but in the embodiments shown in FIGS. 5-6 and 9-10, the securing formations 270 will be directly connected to the inflatable bladder 220.

Figure 11:
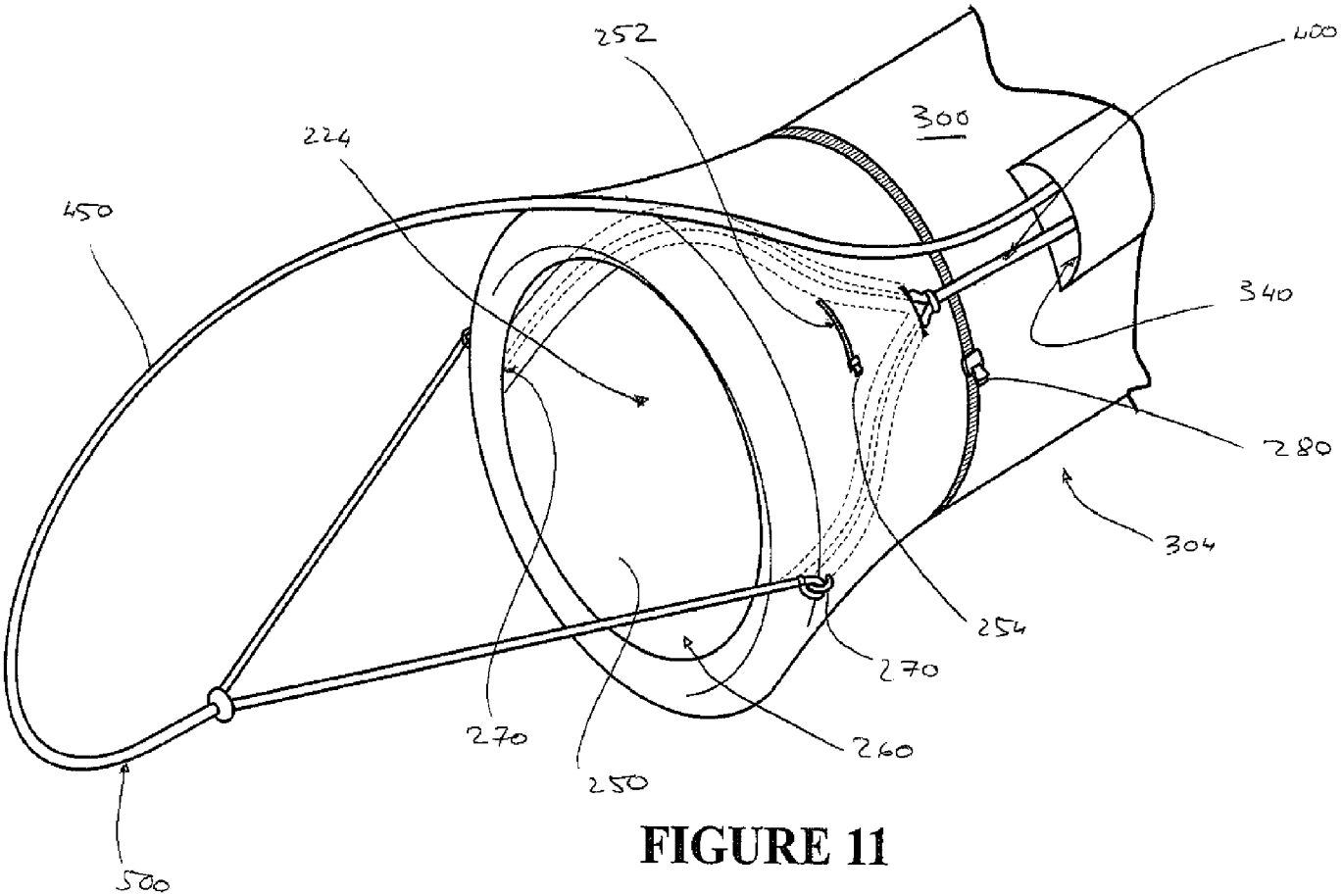
FIG. 11: shows a cutaway perspective view of a sail collapsing arrangement.
Figure 12:
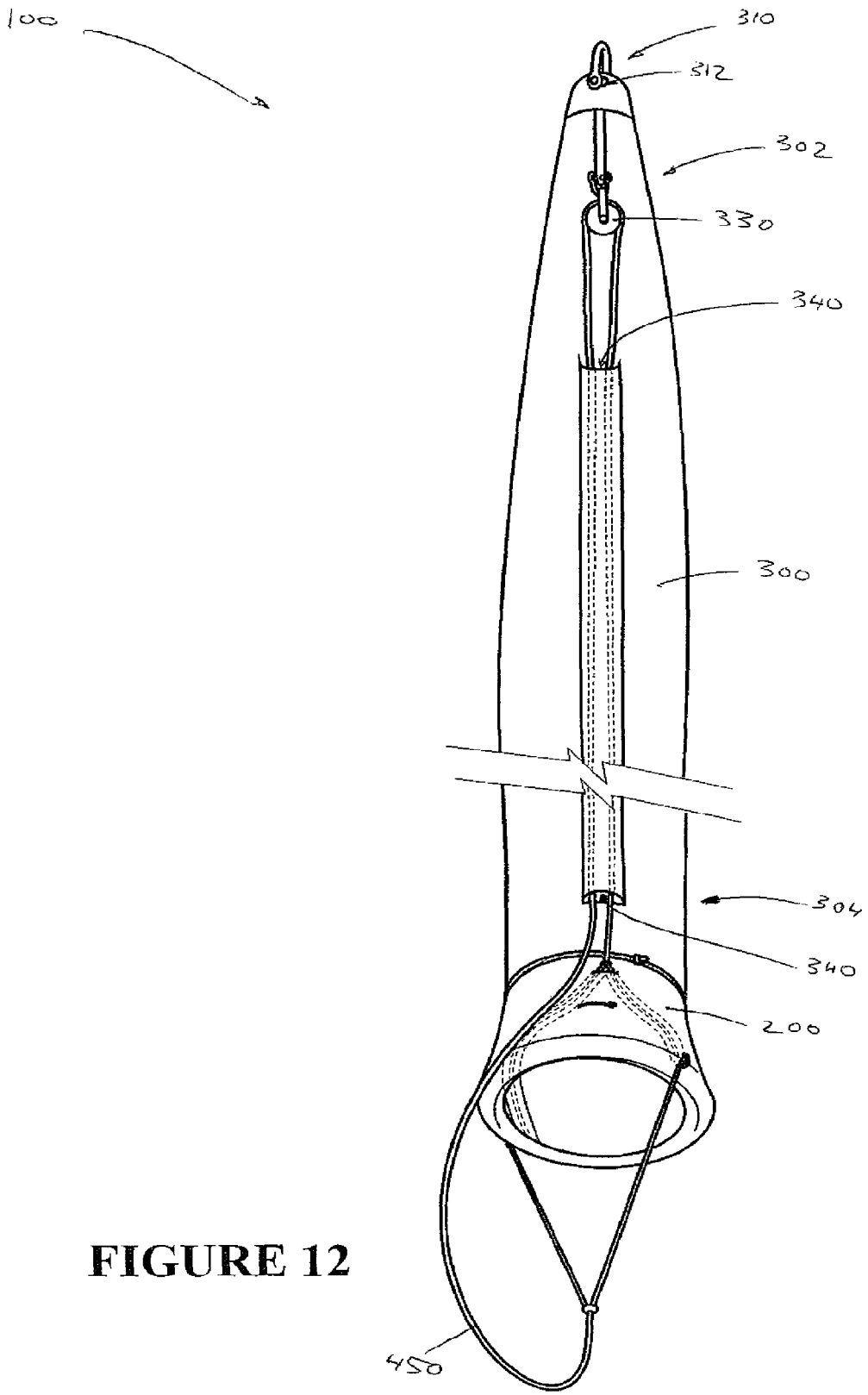
FIG. 12: shows a bottom perspective view of a sail collapsing arrangement.

In a preferred embodiment of the sail collapsing arrangement 100 as shown in FIGS. 2, 11 and 12, the up-haul line 400 and the down-haul line 500 are a single endless line 450 extending from one side of the guide arrangement 200 to the other side of the guide arrangement 200 via at least one pulley 330.

The pulley 330 is secured to the sail sleeve 300 at its top end 302 outside of the sail sleeve 300. A line passage 340 extends along the outside of the sail sleeve 300 substantially along its length. The line passage 340 is a sheet of material attached to the outside of the sail sleeve 300 in a manner to form a passage for receiving the endless line 450.

In use, the endless line 450 extends from the securing formations 270 at the guide arrangement 200 at one end, downwardly through a winch mechanism (not shown) of a sailing boat 700, and back upwardly through the line passage 340. The endless line 450 then extends around the pulley 330 at the top of the sail sleeve 300 and back through the line passage 340, after which it is attached to the securing formations 270 at the guide arrangement 200.

By using the winch mechanism to pull one way or another, the guide arrangement and sail sleeve can be moved upwardly or downwardly along the sail.

A sail collapsing arrangement 100 according to the invention provides advantages and benefits over the prior art in that the guide arrangement 200, when inflated, is rigid (to be able to properly and quickly collapse the sail), but is relatively lightweight and may not be as dangerous to crew and the rigging in heavy weather.

Further, the guide arrangement 200 may be deflated for convenient and relatively compact storage of the sail collapsing arrangement 100 and sail 600 when it is not required in use. The inflatable bladder is flexible when deflated, which allows the guide arrangement 200 to be folded up and received through small openings (such as the forward hatch of a sailing boat 700), which may not be accessible by a rigid guide arrangement.

In order to de-rig the sail 600 from the sailing boat 700, the down haul line is pulled downwardly, causing the sail width to constrict as it moves through the aperture 224 of the inflatable bladder 220, thereby collapsing the sail 600. Once the sail 600 is at least partially received within the sail sleeve 300, the rigging line 720 is eased to lower the sail 600 and sail collapsing arrangement 100. In one embodiment the up-haul lines 400 and the down-haul lines 500 are then disconnected from the securing formations 270 on the sail collapsing arrangement 100. However in a preferred embodiment, the up haul lines 400 and the down haul lines 500 remain connected to the sail securing formations 270 and are stored with the sail collapsing arrangement 100.

The inflatable bladder 220 is then deflated to allow the guide arrangement to become resilient and suitable for folding or manipulation. Typically, the sail collapsing arrangement 100 and sail 600 would then be stowed through a forward hatch (not shown) on the deck 740 of a sailing boat 700.

Where in the foregoing description reference has been made to elements or integers having known equivalents, then such equivalents are included as if they were individually set forth.

The guide arrangement 200 is required to be light since it is undesirable to have a heavy weight aloft. This is because the weight can have an effect on the sailing characteristics of the sailing vessel. Further, when the sail collapsing arrangement 100 is being rigged (which may typically be together with a spinnaker), this may be carried out in heavy weather. It may be dangerous to have a heavy guide swinging around above the deck. Hard edged moulded guides as used currently may be dangerous to the deck hands, and may damage the rigging or at least chip paint on the rigging (i.e. the mast or spreaders).

Further, where prior art guide arrangements hit against the rigging or the like, they may develop a sharp edge or a crack in it. When the cracked prior art guide is then used to douse the spinnaker the following time, this hard edge or crack may cut or tear the sail. This is highly undesirable in both the context of potentially losing a regatta, and in light of the typical cost of replacement of spinnakers on super yachts, which may be very high. The use of a guide arrangement according to the current invention helps prevents such incidences Large super-yacht's may typically have up to four spinnakers in their sail inventory of varying sizes. These may have a snuffer or douser associated with each spinnaker. The size of snuffer guide for a large super-yacht may typically be about 1200 mm by 600 mm (across the transverse diameters of the oval shape) and even up to 2000 mm by 1000 mm. The snuffers must be stored below deck when the associated spinnaker is not in use. Currently the prior art rigid snuffer guides do not facilitate convenient storage of the spinnaker and snuffers. The use of a resilient inflatable guide arrangement 200 according to the invention assists in reducing this problem, since it reduces the volume of the sail 600 and sail collapsing arrangement 100.

Further, the spinnaker is typically stowed below deck through a forward deck hatch (not shown). Prior art snuffer guides may not always be of the correct dimensions to be stored below deck through the forward deck hatch, and may instead be required to be taken below deck and stored via the rear hatch. This process may be wasteful of the deck hand resources on a sailing vessel, especially when the vessel is sailing short handed. The use of an inflatable guide arrangement 200 and sail collapsing arrangement 100 as described also allows for more convenient storage access.

Although the invention has been described by way of example and with reference to particular embodiments, it is to be understood that modifications and/or improvements may be made without departing from the scope or spirit of the invention.

In addition, where features or aspects of the invention are described in terms of Markush groups, those skilled in the art will recognise that the invention is also thereby described in terms of any individual member or subgroup of members of the Markush group.

What is claimed is:

1. A guide arrangement suitable for use in a sail collapsing arrangement, said guide arrangement comprising a. a guide comprising a generally toroidally shaped resilient inflatable bladder defining an aperture, said aperture configured and dimensioned to receive a sail therethrough and to cause crimping and collapse of the sail as the sail passes through the aperture so that the portion of the sail that has passed through the aperture is able to be received into an elongate sail sleeve engaged to the bladder; and b. at least one securing formation configured and dimensioned to be securable to at least one selected from i. an up-haul line; and ii. a down-haul line wherein the guide is collapsible when not in use.

2. A guide arrangement as claimed in claim 1, wherein the sail sleeve is secured to the bladder via sail sleeve securing formations.

3. A guide arrangement as claimed in claim 1, wherein the inflatable bladder includes at least one inflation valve configured and adapted to allow both inflation and deflation of the inflatable bladder.

4. A guide arrangement as claimed in claim 1, wherein the toroidally shaped bladder is generally elliptical in plan view.

5. A guide arrangement as claimed in claim 1, wherein said resilient inflatable bladder is protected against abrasion by said sail by being composed of, or lined with, flexible abrasion resistant material disposed at least partly around the inside of the aperture.

6. A sail snuffer comprising a resilient inflatable bladder at least partially defining an aperture, wherein the inflatable bladder is configured and dimensioned for operationally crimping a sail passing through the aperture, to thereby cause the collapse of said sail, wherein the bladder is one selected from generally elliptical shaped in plan view and circular shaped in plan view.

7. A sail snuffer as claimed in claim 6, wherein the sail snuffer includes at least one securing formation configured and dimensioned to be securable to at least one or more selected from a. an up-haul line; and b. a down-haul line.

8. A sail snuffer as claimed in claim 6, wherein the inflatable bladder is configured in the shape of a toroid.

9. A sail snuffer as claimed in claim 6, wherein the inflatable bladder has a cross section shape of one selected from an ellipse and a circle.

10. A sail snuffer as claimed in claim 6, wherein the inflatable bladder is protected against abrasion by said sail by a flexible abrasion resistant lining formation disposed at least partly around the inside of the aperture.

11. A sail snuffer as claimed in claim 10 wherein the sail snuffer further comprises a lining sleeve onto which one or more lining formations are incorporated.

12. A sail snuffer as claimed in claim 11, wherein the abrasion resistant lining formation is integrally formed with the lining sleeve.

13. A sail snuffer as claimed in claim 11, wherein the abrasion resistant lining formation is secured to the lining sleeve.

14. A sail snuffer as claimed in claim 7, wherein the sail snuffer additionally comprises a lining sleeve, and wherein the lining sleeve comprises the securing formations and contains the bladder.

15. A sail snuffer as claimed in claim 6, wherein the sail snuffer includes sail sleeve securing formations adapted and configured for being secured to a sail sleeve configured to at least partially receive said sail.

16. A sail snuffer as claimed in claim 15, additionally comprising a lining sleeve, wherein the sail sleeve securing formations extend from either the inflatable bladder or the lining sleeve.

17. A sail snuffer as claimed in claim 6, wherein the inflatable bladder includes a release valve configured to release the pressure of a pressurized fluid inside the inflatable bladder at a predetermined pressure level.

18. A sail snuffer as claimed in claim 15, wherein either the sail sleeve securing formations and/or the securing formations are one or more selected from zips, hooks, eyelets or loops.

19. A sail snuffer as claimed in claim 6, wherein the inflatable bladder includes at least one inflation valve configured and adapted to allow both inflation and deflation of the inflatable bladder.

20. A lining sleeve suitable for use in a sail collapsing arrangement for collapsing a sail, wherein said lining sleeve is adapted and configured to receive at least part of an inflatable bladder that at least partly defines an aperture, and wherein said lining sleeve includes at least one flexible abrasion resistant lining formation disposed at least partly around the inside of the aperture of the inflatable bladder, for protecting said inflatable bladder against abrasion by a sail during collapsing of said sail, wherein the bladder is one selected from generally elliptical shaped in plan view and circular shaped in plan view.

21. A guide arrangement suitable for use in a sail collapsing arrangement, said guide arrangement comprising a generally circular, or oval, in plan view resilient inflatable bladder configured and dimensioned to operationally receive a sail at least partially through it, thereby causing the collapse of said sail, wherein the inflatable bladder includes a release valve configured to release the pressure of a pressurized fluid inside the inflatable bladder at a predetermined pressure level.

* * * * *